United States Patent [19]

Kowalik et al.

[11] Patent Number: 4,533,895

[45] Date of Patent: Aug. 6, 1985

[54] TIME DELAY FUSE

[75] Inventors: Joseph W. Kowalik, Skokie; David J. Krueger, Arlington Heights, both of Ill.

[73] Assignee: Littelfuse, Inc., Des Plaines, Ill.

[21] Appl. No.: 623,824

[22] Filed: Jun. 22, 1984

[51] Int. Cl.[3] ..... H01H 71/20

[52] U.S. Cl. ..... 337/165; 337/163; 337/293

[58] Field of Search ..... 337/165, 164, 163, 166, 337/292, 293

[56] References Cited

U.S. PATENT DOCUMENTS

| | | | |
|---|---|---|---|
| 2,577,531 | 12/1951 | Laing | 337/165 |
| 2,657,294 | 10/1953 | Laing | 337/165 |
| 2,688,677 | 9/1954 | Laing | 337/164 |
| 2,787,684 | 4/1957 | Laing | 337/164 |
| 3,253,103 | 5/1966 | Fister | 337/293 |
| 3,854,111 | 12/1974 | Urani | 337/165 |
| 4,184,137 | 1/1980 | Gaia et al. | 337/293 |

*Primary Examiner*—Harold Broome

*Attorney, Agent, or Firm*—Russell E. Hattis; Stephen R. Arnold

[57] ABSTRACT

A slow-blow electrical fuse structure features one or more conducting fuse links for high-current blow-out protection and located in individual chambers filled with arc-quenching filler and in thermal contact with a spring-loaded piston-and-guide structure soldered into an extended position and similarly soldered to one of the fuse links by an extension leading through a chamber-separating insulating partition washer. At overload the heat from the fuse links melts the aforementioned soldered junctions, causing the spring to collapse the piston over the guide, simultaneously withdrawing it from the chamber, thereby breaking the circuit. A similar chamber-defining washer is captively affixed to the opposite end of the piston-and-guide assembly affixed to the optional second fuse link, both partition-forming washers being rotatingly captively secured to the ends of the piston-and-guide assembly by specially configured apertures therein. A modified version of these support washers allows the use of multiple fuse assemblies.

28 Claims, 21 Drawing Figures

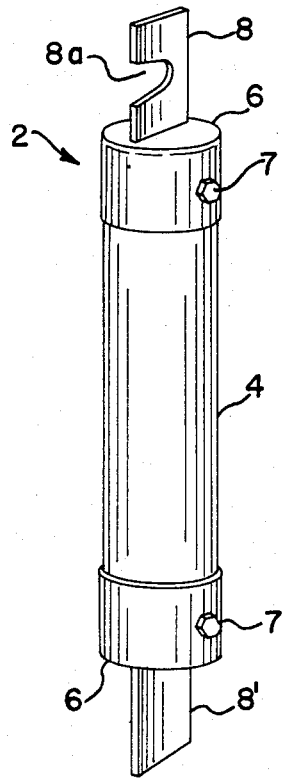
FIG. 1
FIG. 2
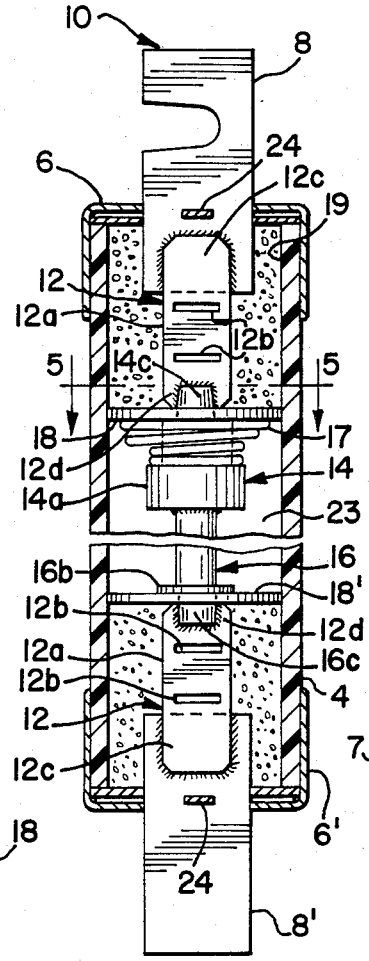
FIG. 3
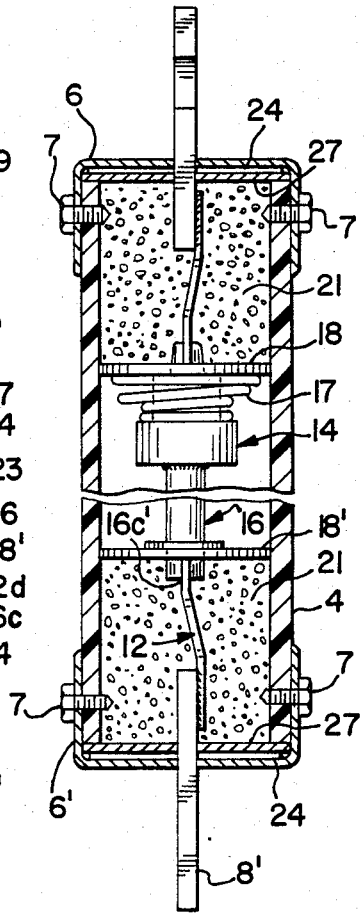
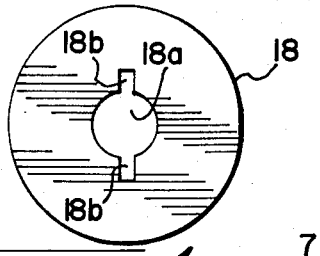
FIG. 4
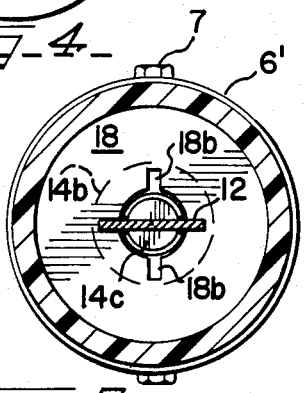
FIG. 5
FIG. 6
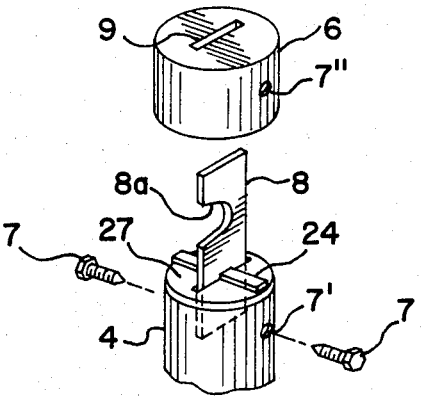

FIG. 7
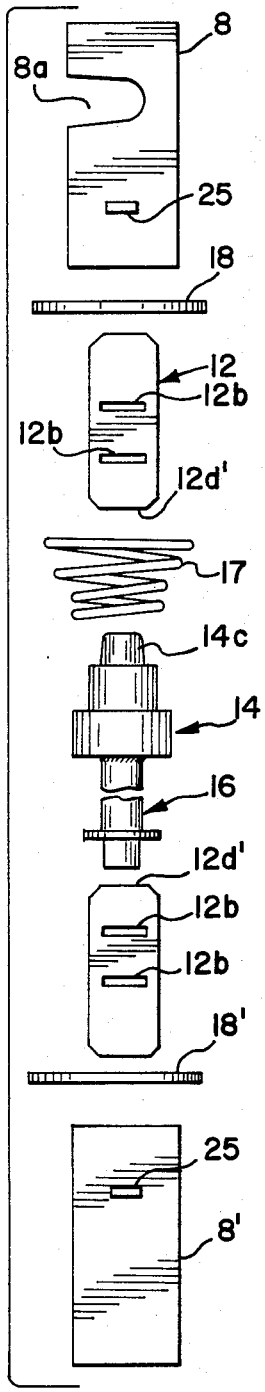
FIG. 8
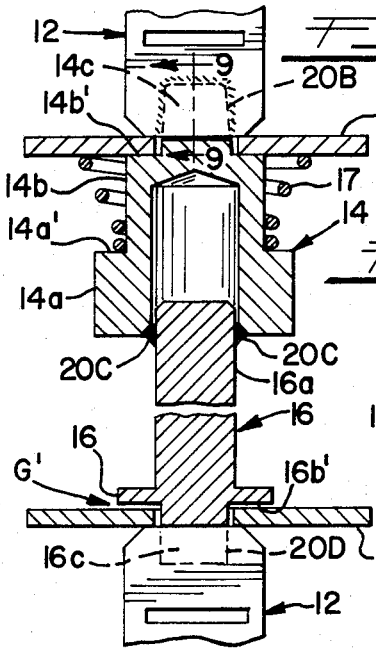
FIG. 9
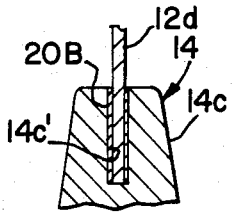
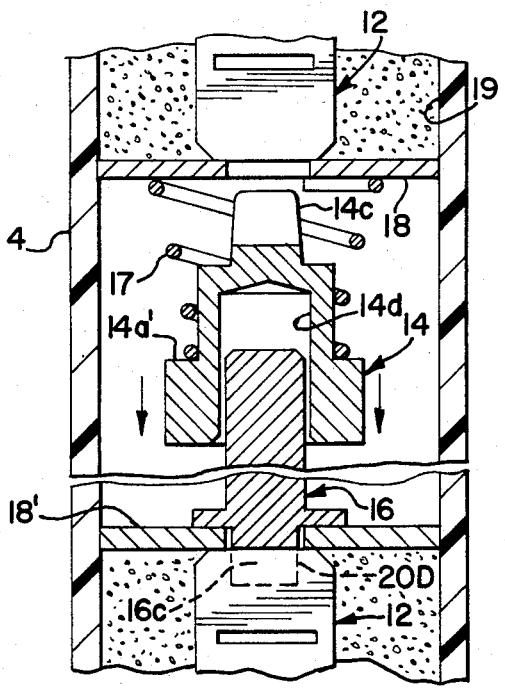
FIG. 10

11B

11C

11D

11E

11F

11G

TIME DELAY FUSE

TECHNICAL FIELD OF INVENTION

The most important application of the invention is in time delay blade terminal-type fuses which give both short circuit protection and a time delayed protection under prolonged modest overload currents. These blade terminal fuses commonly have normal current ratings of from about 65 amperes to as much as 200 amperes for single fuse unit designs, and up to as much as 600 amperes in fuse designs which parallel two or more fuse units in a single housing. However, the invention is applicable to lower current, ferrule terminal-type fuses.

BACKGROUND AND SUMMARY OF INVENTION

Time delay blade-type and ferrule-type fuses have heretofore commonly comprised a cylindrical housing of insulating material having terminals, blades or caps, which extend generally axially from the opposite outer ends of a cylindrical housing. Connected between these terminal blades or caps within the housing are a series of axially spaced interconnected elements including a pair of current-heatable, short circuit protection strips respectively located in arc-quenching sand- or powder-filled outermost compartments, and heat and current conducting elements and spring elements in a central compartment which does not have any sand or powder therein. The short circuit protection strips will melt under short circuit conditions, and the arc-quenching sand or powder quickly quenches the resulting arc.

The elements in the central compartment usually include a thermal mass which accumulates heat generated in the current heatable strips in the outermost compartments. In some cases, the thermal mass forms both a heat conducting and a heat accumulating element. One of the current-conducting elements in the central compartment is sometimes an axially movable plunger element guided for movement along a guide element, and secured through heat-meltable solder junctions to both the guide element and a portion of one of the current-heatable short circuit protection strips in one of the end compartments. In one prior art design, the plunger projected into one of the sand- or powder-filled end compartments and was secured therein to the latter strip through one of the heat meltable junctions referred to.

In prior art initially compressed or extended coil springs are generally provided in the central compartment to place the plunger, connected through the heat meltable junctions to other elements, under spring compression or tension. Thus, when the thermal mass accumulates sufficient heat under a modest overload (e.g. 135% overload) to melt these solder junctions, the spring force pulls or pushes a plunger to quickly separate the current-carrying portions of the fuse. In the prior art fuses where an extension of the plunger extends into one of the end compartments, the arc formed by the separation of this extension from the heat-meltable junction results in an arc which desirably is extinguished by the arc-quenching sand or powder in that compartment. This feature is desirably included in the preferred form of the invention.

In many of these prior art fuse designs, because of the design and relationship of the various elements in the central compartment thereof, automation of the fuse assembly was difficult to achieve. Also, the outermost and central compartments of these fuses are often illdefined by disk-shaped, insulating washers fitted into the housing. Many of these washers were not stably held in position in prior art fuses, so that they sometimes shifted in position, leaving clearance spaces for the sand or powder in the outermost compartments to leak into the central compartment thereof.

In the most preferred form of the invention, disk-shaped insulating washers are provided which are stably supported, and one of them performs a unique function of holding a depressible coil spring in place in the central compartment. Because of this and other features of the invention, there is provided a fuse of very simple and reliable construction, characterized by simplicity of assembly. Also, because of the construction of the basic fuse unit, a plurality of parallel connected fuse units to achieve a high current rating can be readily assembled within a common housing.

In connection with the features of the invention where one of the compartment-defining washers has an added function of retaining a coil spring in a depressed condition (although a broader aspect of the invention does not require the washer to perform this compartment-defining function), the disk-shaped washer is preferably provided with a central opening having a circular central section from which there project, from diametrically opposite sides thereof, aligned slots which correspond in shape and size to the cross section of the adjacent current-heatable short circuit protection strip.

The plunger or other axially movable current conducting element to be located in the central compartment has an axially facing shoulder against which one end of the coil spring to be depressed is placed before the washer is placed on the initial subassembly of the various current conducting and thermal mass elements held together by various solder junctions described. The washer described is then oriented to align the washer opening slots with the short circuit protection strip adjacent the other end of the spring. The washer is then inserted over and slid axially inwardly along the strip first to a point where the washer compresses the coil spring, and then further is passed beyond the strip to pressingly engage another axially facing washer support shoulder on the plunger, at which point the circular central section of the washer opening surrounds a circular extension of the plunger. The coil spring being thus compressed to the desired degree, the washer is then rotated to bring the radially extending slots referred to out of alignment with the current-heatable strip so that the washer then is closely sandwiched between the washer support shoulder of the plunger and the inner end of the strip, and is further securely held in place by the outward force exerted by the compressed coil spring. The washer support shoulder is configured sufficiently wide to completely facingly obstruct the washer slots, thereby preventing leakage of arc-suppressing filler.

Where a second current-heatable strip is to be employed connected to the other end of the plunger assembly and occupying a similarly sealed compartment at the opposite end of the structure a second partition wall is preferably formed by a similar washer with an opening having a circular central section and aligned slots as above described and extending therefrom so that it can be similarly slid axially along the other current-heatable short circuit protection strip. When the washer passes beyond the inner end of the latter strip, it surrounds a circular extension of a member to be located within the central compartment of the fuse housing. Rotation of the washer will then bring the washer in a preferably secure position held closely captive between an axially facing shoulder of the latter member and the inner end of the latter strip. The sandwiching shoulders and strip ends described brace and rigidify the washers involved so that they will remain in position and serve as reliable sand or filler retaining partition walls when the assembly is fitted into the fuse housing.

In accordance with a specific aspect of the invention, the latter member forms a cylindrical plunger guide member which fits within and is located at the open end of a guide member-receiving bore of the plunger described. The plunger guide member is secured to the plunger thereat through a solder junction which melts about the same time as the solder junction which connects the other end of the plunger with the current heatable short circuit protection strip at the opposite end of the fuse.

In accordance with a form of the invention where the fuse includes two or more fuse unit subassemblies connected in parallel and mounted within a common housing, a similar multi-fuse unit subassembly is formed through the aid of a pair of fixedly held axially spaced washers similar in some respects to those described but having a number of openings, each having a central circular section from which project one or more pairs of aligned strip-receiving slots conforming to the cross section of one or more strips which are to be received thereby. In this form of the invention, the individual fuse unit subassemblies are mounted within the axially spaced washers by insertion of each such subassembly with uncompressed coil spring in place thereon into the corresponding aligned washer openings and then rotating the same into position where the springs are held in a compressed condition to complete an overall assembly containing two or more fuse unit subassemblies to be connected in parallel when the blade or other terminals are secured to the outer ends of the strips involved. Another aspect of the invention is the novel assembly method for both forms of the fuse described.

The above and other features of the invention will become apparent upon making reference to the specification to follow the claims and the drawings.

DESCRIPTION OF DRAWINGS

FIG. 1 is perspective view of a blade terminal-type fuse to which the present invention is applied;

FIG. 2 is a fragmentary longitudinal sectional view through the fuse shown in FIG. 1 showing a pair of washers defining a central cavity therein;

FIG. 3 is a longitudinal sectional view of the fuse taken at right angles to the sectional view of FIG. 2;

FIG. 4 is a plan view of either one of the washers shown in FIGS. 2 and 3 which form partition walls between an outermost compartment of the fuse housing and the central compartment thereof;

FIG. 5 is a transverse sectional view through the view shown in FIG. 2, taken along section plane 5—5 (with arc-quenching filler not shown) to illustrate the relationship between a key-shaped opening at the center of the washer which depressed a coil spring of the completed fuse;

FIG. 6 is a fragmentary exploded view of the upper end of the fuse shown in FIGS. 2 and 3, i.e. the end cap exploded view;

FIG. 7 is an exploded view through the various parts making up the main fuse assembly which is inserted into the initially open ends of the fuse housing;

FIG. 8 shows the assembly of the parts shown in FIG. 7 except for the terminal blades, which do not appear in the figure;

FIG. 9 is a somewhat enlarged fragmentary sectional view as seen in section plane 9—9 in FIG. 8 which shows the manner in which the short circuit protection strip 12 fits into place within a slot in an extension of the plunger member;

FIG. 10 is a fragmentary longitudinal sectional view through the central portion of the fuse showing the disposition of the various parts of the fuse when the prolonged overload current blows to create a blown condition of the fuse;

FIGS. 11A–11G show various steps in the assembly of the fuse shown in FIGS. 1–10;

DESCRIPTION OF EXEMPLARY EMBODIMENTS OF THE INVENTION SHOWN IN THE DRAWINGS

Figure 11A:
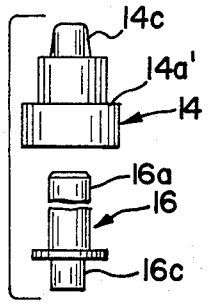
Figure 11A:
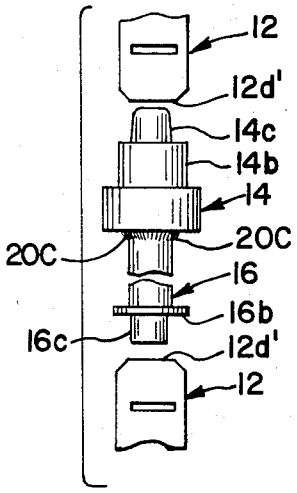
Figure 11A:
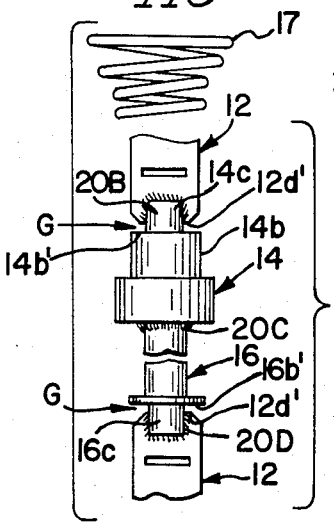
Figure 11A:
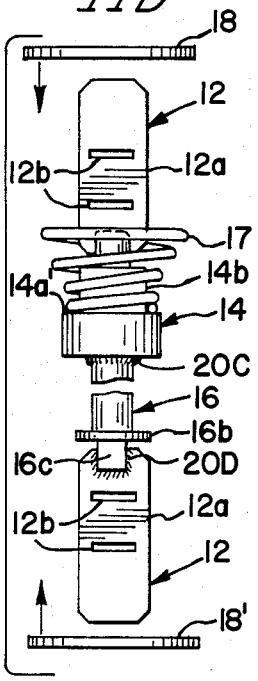
Figure 11A:
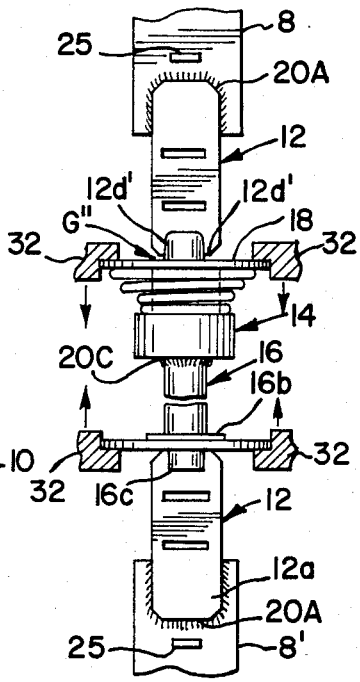
Figure 11A:
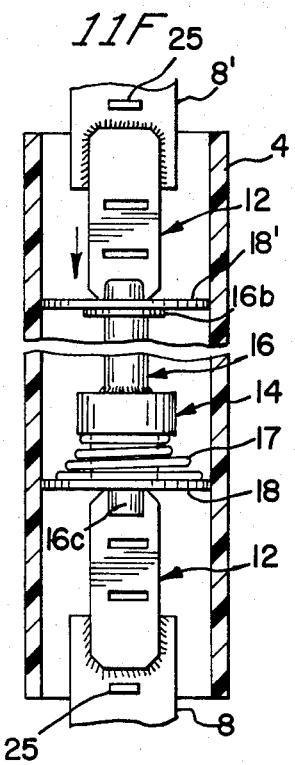
Figure 11A:
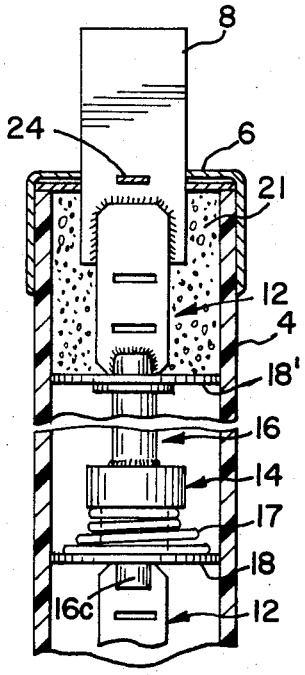

Refer now to FIGS. 1–10 which illustrate one form of the invention used for the lower range of current ratings, as contrasted to the form of the invention to be described shown in FIGS. 12–15 which show the embodiment of the invention used for the higher range of current ratings, both being blade-type terminal fuses. Thus, as shown in FIGS. 1–10, the fuse 2 comprises an initially open-ended cylindrical housing 4 made of a suitable insulating material. Secured over the initially open ends of the housing 4 are cup-shaped end caps 6–6' which are secured in place upon the housing by screws 7. Projecting through apertures 9 in the end caps (FIG. 6) are knife blade terminals 8–8', the upper one of which is shown having a cut-out **8*a* conventionally used in such fuses. The terminals 8–8' are attached to an all-metal subassembly 10 (see also FIG. 11C), to be described, which is mounted within the housing 4** in a manner to be described.

This all metal subassembly 10 includes short circuit protection current-heatable strips 12—12 (current heatable means) to be located axially along the opposite ends of the housing 4. These strips 12 have a central body portion **12*a* having slots 12*b*—12*b* which form current flow restrictions in the strip so that, upon short circuit current flow therethrough, the heat developed by the higher resistance section of these strips provided by the slots 12***b* cause the strips to melt and interrupt the circuit.

The outer end portions of strips 12 are welded or soldered to the side faces respectively of the terminals 8–8′. In higher current rated fuses a pair of such strips 12 would be used at each end of the housing with the associated blade 8–8′ terminals sandwiched therebetween, as shown in the embodiment of the invention of FIGS. 12–15. The inner end portions 12*d* of these strips fit into slots 14*c′* (see FIG. 9) in extensions 14*c* and 16*c* respectively of a plunger member 14 and a plunger guide member 16.

The metal parts 12, 14, and 16 are interconnected by solder junctions 20B, 20C, and 20D (see FIGS. 8, 9, and 11C). The solder junctions 20B and 20C comprise solder filling the aforementioned slots in the end portions 14*c* and 16*c* of the plunger 14 and plunger guide member 16. As best shown in FIG. 8, the plunger guide member 16 has a cylindrical main body portion 16*a* whose inner end fits into the opening of a longitudinally extending bore 14*d* in the plunger member 14. The solder junction 20C secures this end of the plunger guide member 16 to the plunger member 14. The plunger guide member 16 has adjacent to the extension 16*c* thereof a flange 16*b* defining an outwardly axial facing shoulder 16*b′*, which serves a purpose to be described. The solder junctions 20B and 20C should preferably have the same melting temperature at a value substantially below that of junction 20D. Junctions 20B and 20C will melt when a prolonged modest (i.e. 135%) overload current lasting for a given minimum period of time is passed through the structure.

The plunger member 14 has an enlarged inner end portion 14*a* defining an axial facing shoulder 14*a′* facing in the direction of the adjacent short circuit protection strip 12, and an intermediate body portion 14*b* which defines an outwardly axial facing shoulder 141*b′* located at the base of the plunger extension 14*c*.

The various parts of the all-metal subassembly 10 (FIG. 11C) can be conveniently assembled and soldered together by well-known means. This all-metal subassembly 10 is incorporated into a main assembly comprising all of the parts shown in exploded view FIG. 7 and which is inserted as a unit into one of the open ends of the housing 4. This assembly includes, in addition to the all metal subassembly just described, preferably a conically shaped coil spring 17 which is placed around the intermediate portion 14*b* of the plunger member 14 with the narrow end thereof bearing on the axially facing shoulder 14*a′*, and with its wider opposite end initially surrounding the inner end portion of the short circuit protection strip 12. This coil spring is compressed into the state shown in FIG. 8 preferably by means of a disk shaped washer 18 (spring holding member). The washer 18 is preferably of insulating material, and is held in a locked position between the plunger member shoulder 14*b′* and the end 12*d′* of the adjacent short circuit protection strip 12. Another similar washer 18′ (partition-defining member) is located between the flange 16*b* on the plunger guide member 16 and the inner end of its associated short circuit protection strip 12. In addition to the spring compressing function of the first mentioned washer 18, when the assembly is mounted within the housing 4 (FIG. 3) the washers 18 and 18′ form partition walls dividing the interior of the housing 4 into two outermost compartments 19—19 filled with an arc-quenching filler such as sand 21 and a central compartment 23 which contains the spring 17, plunger member 14 and plunger guide member 16.

It is apparent that, because the washers 18–18′ are closely confined between the various shoulders described, the washers are supported and rigidified by these shoulders so that the washer cannot readily deflect or deform. These washers are fitted into the housing interior on assembly so that they prevent the passage of the arc-quenching material 21 into a central compartment.

Referring now more particularly to FIGS. 2, 3, and 6 there extends over each outer end of the housing 4 a closure disk 27. Each of these closure disks 27 is retained in place by a key 24 which passes through an opening 25 (FIG. 7) in the associated blade terminal 8 or 8′. The end caps 6–6′ enclose the outer end portion of the housing 4, and by means of the securing screws 7 passing through holes 7′ and 7″ completely enclose and secure in position the closure disks 27 and keys 24.

Refer now to FIG. 10 which illustrates the operation of the fuses upon a prolonged modest current overload. During the flow of such overload current, the heat developed in the short circuit protection strips 12 flows through the plunger 14 and plunger guide member 16, which act as heat accumulators or thermal masses, to gradually soften and melt the solder junctions 20B and 20C. The tendency of the spring 17 to expand places a force on the solder junction 20C, hence ultimately this spring force will propel the plunger 14 down over the plunger guide member 16, separating the plunger member 14 from the short circuit protection strip 12 adjacent thereto, as best shown in FIG. 10. Before such separation the plunger guide member 16 and plunger 14 form low resistance paths for current flow between the blade terminals 8–8′. Upon separation of the plunger member from the adjacent short circuit protection strip 12 the continuity of the fuse is terminated.

To facilitate this separation, the extension 14*c* of plunger 14 is provided with a slight taper as shown. Further, it will be noted in FIG. 10 that the upper portions of the spring 17 are held widely spaced from the central regions of the structure where the arc fireball is localized upon separation, thus minimizing the possibility of arc travel from the upper current-heatable member 12 along the spring to maintain the arcing condition overly long during separation.

It is to be noted that the arc which will develop upon the initial separation of the plunger member extension 14*c* from the adjacent strip 12 occurs in the sand filled compartment 19 so that arc quenching occurs quickly and effectively. Also, the washers 18–18′ are preferably made of a vulcanized fibre material which upon the initiation of an arc develops loose carbon deposits which are readily blown away from the area of the arc, and thus this fibre material of the washer acts to aid the arc-quenching process which would not occur, for example, if the washers 18–18′ were made of other types of materials.

Considering next the assembly of the structure shown in FIGS. 1–10, FIG. 11A shows the plunger member 14 and the plunger guide member 16 aligned for insertion. In FIG. 11B, the plunger member 14 and plunger guide member 16 have been soldered together, having the solder junction 20C as shown. The strips 12—12 are shown positioned for insertion into the slots 14*c′* (FIG. 9) in the outer ends of the plunger member 14 and the plunger guide member 16 respectively. These strips 12 after insertion are then held captively secured to these respective ends by solder means at junctions 20B and 20C as shown in FIG. 11C. The conical coil spring 17 is then slid down over the assembly as shown in FIG. 11D to be supported on the upwardly facing shoulder 14a' as shown in FIG. 11D. The washers 18–18' are shown positioned to be slid along the strips 12—12 into locking engagement therewith.

An important aspect of the invention is the design of a central aperture 18a in each washer 18–18' which enables it to be assembled to the subassembly 10 in a convenient manner. To this end, each washer 18–18' (FIG. 4) has a key-shaped aperture in the form of a central circular center portion 18a from which project a pair of aligned slots 18b—18b which have a shape and size slightly larger than the rectangular cross-sectional shape of the short circuit protection strip 12. Thus, the key-shaped slots enable each washers 18–18' to be conveniently slid over the short circuit protection strips (current-heatable strips) 12—12 before these strips are attached to the knife blade terminals 8–8'. Thus, as shown in FIG. 11E, when the above mentioned washers 18–18' reach the shoulders 14b and 16b of the plunger 14 and guide 16 respectively, each is rotated 90°. This rotation is enabled by the circular center section of the key-shaped opening 18a, which conforms in size and shape to the circular cross section of the extensions 14c and 16c (FIG. 11A) of the plunger member 14 and the plunger guide member 16 respectively. When these washers are rotated, they are frictionally retained in their adjusted positions as shown in FIG. 5.

In this respect, considering in particular the phase of assembly shown in FIG. 11C, the short circuit protection strips 12—12 are positioned during assembly with respect to the plunger 14 and guide 16 to provide closely controlled gaps G—G between the end shoulder portions 12d'—12d' of the strips 12 and their respective opposing faces 14b' and 16b'. Rotation of emplaced washers 18–18' about these regions causes them to be tightly and captively secured and rigidified. The residual gaps G' (FIG. 8) and G'' shown in FIG. 11E (to be discussed next), are exaggerated in the drawings for purposes of explanation only; in practice these residual gaps are held quite small by the previously mentioned closely controlled maintenance of proper separation during assembly.

Further to the assembly phase indicated in FIG. 11E, and with reference to FIG. 5, the plunger guide flange portion 16b and its counterpart portion 14b on the plunger are configured to be slightly greater in diameter than the maximum extension of the slots 18b shown in FIG. 5. Thus, rotation of washer 18–18' causes them to be captively and lockingly secured against facially abutting portions of their respective support elements, thereby preventing leakage of arc-quenching filler material through these passages after assembly. Thus, upon rotation, washers 18–18' are not only captively and rigidly secured, but their compartment-isolating feature is retained in spite of the presence of assembly slots 18b thereon.

FIG. 11E shows in functional form four jig jaws 32 holding the washers 18–18' in compression for subassembly locking rotation. Upon release of compression, washer 18 is spring-urged directly against shoulders 12d'. FIG. 11E also shows the knife blade terminals 8–8' suitably attached as for example by high melting solder junctions 20A—20A. The entire assembly shown in FIG. 11E is then fitted into the housing 4, and finally, as shown in FIG. 11G, each end chamber is filled with suitable quenching filler 21, to be retained therein by sliding the closure disks 27 into place to be retained by keys 24 (FIG. 6). The end caps 6–6' are then placed over the assembly to be held in position by the securing screws 7.

Figure 12:
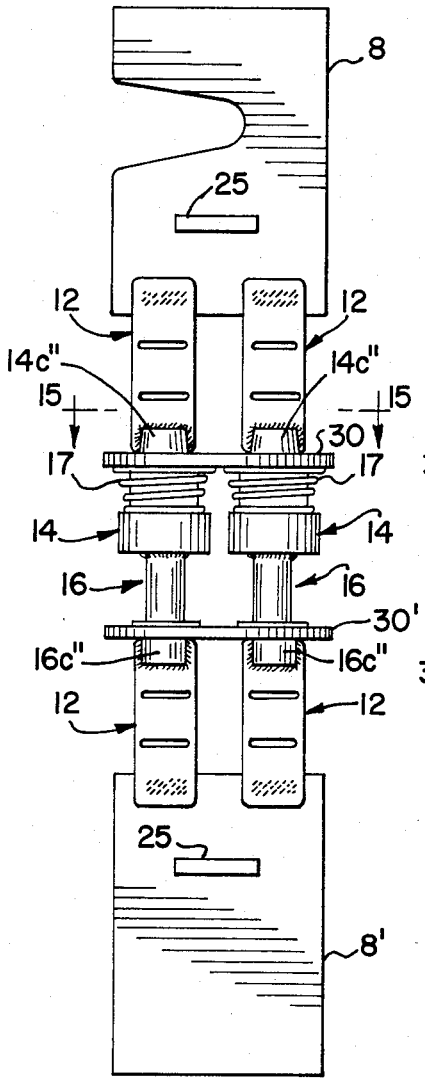
FIG. 12 shows a modified fuse unit assembly where the interior portion of the fuse comprises a pair of fuse unit subassemblies similar to the single fuse unit subassembly shown in FIGS. 1–11 and wherein the fuse unit subassemblies are connected in parallel to increase the current rating of the fuse.
Figure 13:
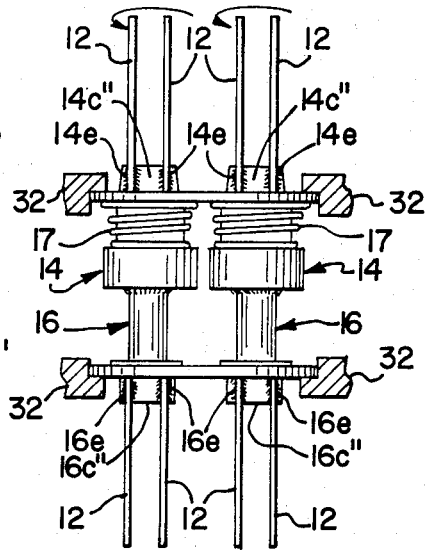
FIG. 13 shows a pair of the fuse unit subassemblies of FIG. 12 prior to the attachment of the terminal blades thereto being assembled where the all-metal portion thereof is initially passed through two stationary spaced washers to stay in a stationary position to permit rotation of the all-metal portion of the subassembly into its condition where it locks the coil springs involved in their compressed conditions.

FIGS. 12 and 13 shows an alternative version of the fuse element employing two subassemblies captively retaining washers 30 and 30'. Here each assembly is shown having a pair of short circuit protection strips 12—12 affixed to either end of the plunger-plunger guide assemblies.

Figure 14:
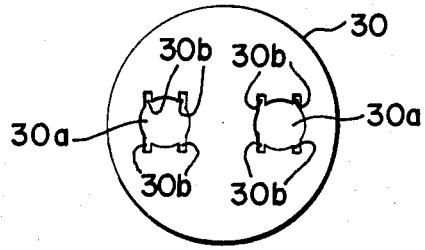
FIG. 14 is a plan view of either one of these washers showing the shapes of the pair of apertures contained therein for receiving the all metal portions of the fuse unit subassemblies described.
Figure 15:
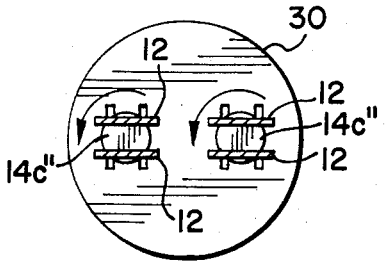
FIG. 15 is a transverse sectional view through the fuse shown in FIG. 12.

With respect to assembly, the sequence is similar; however, because of the use of two strips 12—12 with each subassembly end, a modified chamber-sealing disk 30 shown in FIG. 14 is employed. Each of the two circular apertures 30a—30a therein has associated therewith slot-like cutouts 30b—30b configured to accommodate a pair of strips 12—12 for insertion. FIG. 13 shows an intermediate assembly phase with a pair of disks 30–30' slid over the respective strips 12—12. In the preferred form of assembly, after the disks 30–30' have been so emplaced and a compressing force applied therebetween by suitable fixture 32, each assembly may be individually rotated as shown in FIG. 13 to bring the interior ends of the strips 12–12 into arresting engagement with the interior faces of washers 30–30' as illustrated in FIG. 15, which shows the locked configuration, thereby placing four strips 12—12 into parallel alignment. Subsequent to this operation, the outer ends of the strips 12 may be secured in pairs to the blade terminals 8–8' by methods previously described.

Thus, there has been described a fuse design configured for ease of assembly. The special chamber-defining disks 18–18' and 30–30' serve the multiple functions of (1) conveniently securing an entire subassembly for insertion by a simple slip-on rotational locking feature, (2) providing centering of the structure during assembly and thereafter, (3) serving as chamber-defining and filler-retaining partitions defining the three chambers of the structure, and (4) biasingly retaining the spring 17 against the plunger 14.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falling within the scope of the appended claims.

Thus, for example, although in the preferred form of the invention the washers 8–8' are fitted into the housing 4 during assembly, alternatively one or more internal projections may be formed in the interior housing walls to restrain these elements either at one or both ends, without departing from the scope of the invention disclosed herein.

Moreover, it should be recognized that the principal purpose of the spring 17 is not to retain the upper washer 18, that member being already captively secured by means already discussed, but rather to supply a compressive force to the plunger 14 with respect to the guide 16. Thus, a great variety of springs may be equally well applied to this purpose. A simple U-shaped spring could be slidably inserted from one side to provide a similar downwardly urging force on the plunger 14 (FIG. 2), or alternatively a differently configured spring could be affixed at one end to the plunger guide 16, with the other end secured under tension to the plunger 14. Additionally, one end of whatever spring member is employed could equally well be anchored to a hook, stake, or other projection or shoulder formed integrally with the wall of the housing 4. Such latter forms of assembly could be particularly and economically applicable to simpler fuse assemblies having only a single current-heatable 12 in an upper chamber, the lower filler-filled chamber of FIGS. 2 and 3 being deleted entirely, and having the plunger guide 16 attached directly to the blade element 8'. All such variants are to be construed as within a scope of the invention disclosed herein.

We claim:

1. In a time delay fuse having an insulating housing with conductive terminals at the opposite axial ends thereof, and a subassembly including axially disposed first current-heatable means connected to one of said terminals and current-carrying means electrically coupled in series between said first current-heatable means and the other terminal to complete a circuit between said terminals, said first current-carrying means including a member axially movable above a given temperature and coupled to said first current-heatable means through a heat meltable connection, spring means for urging said axially movable member in an axial decoupling direction away from said first current-heatable means to separate and decouple the current-carrying means from said first current-heatable means so that upon the melting of said heat meltable connection said current-carrying means is separated and decoupled from said first current-heatable means, said heat meltable connection being in heat coupled relation to said first current-heatable means so that a prolonged modest overload of current flow through said first current-heatable means over a given time period will at least soften said heat meltable connection; the improvement wherein said spring means includes an axially compressed spring having one axial end which bears against a first axially facing shoulder on said axially movable member to urge said axially movable member in said decoupling direction, and spring holding means for holding said spring means in an axially compressed state, said holding means including a spring holding member initially axially movable relative to said first current-heatable means so as to allow placement of said holding member at a given relative axial position where said holding member bears against and compresses said spring means, and lockable into said given axial position when rotated relative to said subassembly in a transverse plane where it is held by spring force in position against a second shoulder in said housing.

2. The time delay fuse of claim 1 wherein said first current-heatable means comprises at least one axially extending thin strip of metal, said holding member having a circular opening from the opposite sides of which extend a plurality of aligned slots conforming in size and shape to the cross section of said at least one current-heatable strip so as to slidably receive the same, said axially movable member having an axial extension with a circular cross section conforming to the size of said central circular opening in said holding member so that when said holding member is beyond the inner end of said at least one current-heatable strip it can be rotated relative to said strip and said axially movable member.

3. The time delay fuse of claims 1 or 2 wherein there is provided on said movable member a third axially facing shoulder positioned to obstructingly limit the axial movement of said spring holding member so that when said spring holding member is urged against said third shoulder it is located at said given relative axial position.

4. The time delay fuse of claim 1 or 2 wherein said spring holding member is a thin disk-shaped member.

5. The time delay fuse of claims 1 or 2 wherein said spring holding member is made of electrically insulating material and extends transversely across the axis of the housing and adjacent to the housing walls, to form a partition wall between two axially spaced compartments of the fuse housing, and wherein there is provided an arc-quenching material in the compartment on the side of the spring holding member remote from said spring means and axially-movable member.

6. The time delay fuse of claims 1 or 2 wherein said spring holding member is made of electrically insulating material and extends transversely across the axis of the housing and adjacent to the housing walls, to form a partition wall between two axially spaced compartments of the fuse housing.

7. The time delay fuse of claims 1 or 2 wherein one end of said first current-heatable means is configured to form said second shoulder.

8. The time delay fuse of claim 1 or 2 wherein said spring holding member is made of electrically insulating material and extends transversely across the axis of the housing and adjacent to the housing walls to form a partition wall between two axially spaced compartments of the fuse housing, there is provided an arc-quenching material in the compartment on the side of the spring holding member remote from said spring means and said axially-movable member, and said axially movable member has an outer end extension which extends through said spring holding member into the compartment having said arc-quenching material, said first current-heatable means being entirely within the latter compartment and being secured to the extension of said axially movable member through said heat meltable connection located in the latter compartment.

9. The time delay fuse of claim 1 or 2 wherein said spring holding member is made of electrically insulating material and extends transversely across the axis of the housing and adjacent to the housing walls to form a partition wall between two axially spaced compartments of the fuse housing, there is provided an arc-quenching material in the compartment on the side of the spring holding member remote from said spring means and said axially-movable member, and said axially movable member has an outer end extension which extends through said spring holding member into the compartment having said arc-quenching material, said first current-heatable means being entirely within the latter compartment and being secured to the extension of said axially movable member through said heat meltable connection located in the latter compartment, and wherein above said given temperature said heat-meltable connection at least softens and said spring means urges said axially movable member to withdraw said extension from said latter compartment.

10. The time delay fuse of claims 1 or 2, wherein said axially-movable member is guided for axial movement within said housing by a stationary guide member received within an axial bore in said axially movable member, and is secured to said guide member by a heat meltable connection which when melted permits said axial movable member to move over said guide member.

11. The time delay fuse of claims 1 or 2 wherein said spring holding member is made of electrically insulating material and extends transversely across the axis of the housing and adjacent to the housing walls to form a partition wall between two axially spaced compartments of the fuse housing, there is provided an arc-quenching material in the compartment on the side of the spring holding member remote from said spring means and said axially-movable member, there is provided a second current-heatable means at the opposite end of said housing to that containing said first current heatable means, said axially-movable member is guided for axial movement within said housing by a stationary guide member received within an axial bore in said axially movable member and is secured to said guide member by a heat meltable connection which when melted permits said axial movable member to move over said guide member, said guide member being affixed to and electrically connected to said second current-heatable means, and there is provided a transverse partition-forming second holding member similar to said spring holding member and slidable axially along the second current-heatable means and when passed beyond the inner end of said second current-heatable means is then relatively rotatable with respect thereto into a position where it becomes captured between a shoulder on said guide member and the end of said current-heatable means, and an arc-quenching material in the compartment on the outer side of said transverse partition-forming member.

12. The time delay fuse of claim 2 wherein said spring holding member is configured with a plurality of such circular openings, said fuse including a corresponding plurality of said subassemblies and spring means lockingly rotatingly affixed to said spring holding member.

13. The time delay fuse of claim 2 wherein said spring holding member is made of electrically insulating material and extends transversely across the axis of the housing and adjacent to the housing walls to form a partition wall between two axially spaced compartments of the fuse housing, there is provided an arc-quenching material in the compartment on the side of the spring holding member remote from said spring means and said axially-movable member, there is provided a plurality of said spring means and subassemblies, each subassembly having a second current-heatable means at the opposite end of said housing to that containing said first current-heatable means, said spring holding member is configured with a plurality of such circular openings, each said axially-movable member is guided for axial movement within said housing by a stationary guide member received within an axial bore in said axially movable member and is secured to said guide member by a heat meltable connection which when melted permits said axially movable member to move over said guide member, said guide member being affixed to and electrically connected to said second current-heatable means, and there is provided a second transverse partition-forming member similar to said spring holding member and slidable axially along the second current-heatable means and when passed beyond the inner end of said second current-heatable means is then relatively rotatable with respect thereto into a position where it becomes captured between a shoulder on said guide member and the end of said current-heatable means, and an arc-quenching material in the compartment on the outer side of said second transverse partition-forming member.

14. The time delay fuse of claim 13 wherein each said first and second current-heatable means comprise a confronting parallel pair of axially extending thin strips of metal.

15. A method for making a time delay fuse comprising the steps of:

providing an insulated housing having a linear passage therethrough;

providing a subassembly including first current-carrying means having a first or movable member axially movable with respect to a second or stationary member above a given temperature, said subassembly including electrically conducting first current-heatable means axially affixed to said movable member by heat meltable means;

emplacing spring means to engage a first axially facing shoulder on said axially movable member so that compression of said spring means against said first shoulder applies a force to said movable member in a disconnecting direction from said first current-heatable means;

providing a spring holding member having an aperture therein configured to insertingly accept said first current-heatable means and configured to present removal-blocking portions to said current-heatable means when said spring holding member is beyond the end thereof and rotated therearound;

sliding said aperture of said spring holding member over one end of said current heatable means and moving said spring holding member to engage and compress said spring means against said first axially facing shoulder on said movable member until said spring holding member aperture is disposed beyond the other end of said current-heatable means;

rotating said subassembly relative to said spring holding member to place said first spring holding member in said removal-blocking position;

releasing said spring means to force said first spring holding member into pressing engagement against said first current heatable means;

affixing axial electrical conducting means to said first current-heatable means and said stationary member of said current carrying means at an end portion thereof to form an insertion assembly providing a series electrical connection between said electrical conducting means, said current-heatable means, and said movable and stationary members of said current-carrying means;

inserting said insertion assembly into said housing passage;

affixing sealing end caps to the ends of said passage, said end caps including means for making electrical contact to said electrical conducting means.

16. The method of claim 15 wherein said spring holding member is made of electrically insulating material and is configured to span said housing passage and sealingly form with its associated end cap a first chamber containing said first heating means.

17. The method of claim 16 further comprising the step of filling said first chamber with an arc-quenching material before affixing the associated end cap thereto.

18. The method of claim 16 further including the step of affixing an axially disposed second heating means to said second or stationary member of said subassembly between said end portion thereof and the associated electrical conducting means, said first and second heating means and said end portions of said movable and stationary members being similarly configured, and further including the step of slidingly rotatingly lockingly affixing an electrically insulating partition-forming member configured similarly to said spring holding member around said end portion of said stationary member to sealingly form a second chamber about said second heating member at the other end of said housing passage.

19. The method of claim 18 further comprising the step of filling said second chamber with an arc-quenching material before applying the end cap thereto.

20. The method of claim 18 wherein said spring holding member and said partition-forming member are each configured with a plurality of such apertures, and further including the step of rotatingly lockingly affixing thereto a corresponding plurality of said subassemblies, spring means, and associated heating means to said spring holding member and said partition-forming member.

21. The method of claim 20 wherein said first and second current-heatable means include a pair of confronting parallel axially extending thin metal strips.

22. The method of claim 15 wherein said first current-heatable means comprises at least one axially extending thin strip of metal, said spring holding member having a circular opening from the opposite sides of which extend a plurality of aligned slots conforming in size and shape to the cross section of said at least one current-heatable strip so as to slidably receive the same, said axially movable member having an axial extension with a circular cross section conforming to the size of said central circular opening in said holding member so that when said holding member is beyond the inner end of said at least one current-heatable strip it can be lockingly rotated relative to said strip and said axially movable member.

23. The time delay fuse of claims 15 or 22 wherein said spring holding member is a thin disk-shaped member.

24. The method of claims 15 or 22 wherein said spring holding member is made of electrically insulating material and extends transversely across the axis of the housing and adjacent to the housing walls to form a partition wall between two axially spaced compartments of the fuse housing, here is provided an arc-quenching material in the compartment on the side of the spring holding member remote from said spring means and said axially-movable member, and said axially movable member has an outer end extension which extends through said spring holding member into the compartment having said arc-quenching material, said first current-heatable means being entirely within the latter compartment and being secured to the extension of said axially movable member through said heat meltable connection located in the latter compartment.

25. The method of claims 15 or 22 wherein said spring holding member is made of electrically insulating material and extends transversely across the axis of the housing and adjacent to the housing walls to form a partition wall between two axially spaced compartments of the fuse housing, there is provided an arc-quenching material in the compartment on the side of the spring holding member remote from said spring means and said axially-movable member, and said axially movable member has an outer end extension which extends through said spring holding member into the compartment having said arc-quenching material, said first current-heatable means being entirely within the latter compartment and being secured to the extension of said axially movable member through said heat meltable connection located in the latter compartment, and wherein above a given temperature said spring means urges said axially movable member to withdraw said extension from said latter compartment.

26. The method of claims 15 or 22, wherein said axially-movable member is guided for axial movement received within an axial bore in said axially movable member, and is secured to said guide member by a heat meltable connection which when melted permits said axial movable member to move over said guide member.

27. The method of claims 15 or 22 wherein said spring holding member is made of electrically insulating material and extends transversely across the axis of the housing and adjacent to the housing walls to form a partition wall between two axially spaced compartments of the fuse housing, there is provided an arc-quenching material in the compartment on the side of the spring holding member remote from said spring means and said axially-movable member, there is provided a second current-heatable means at the opposite end of said housing to that containing said first current heatable means, said axially-movable member is guided for axial movement within said housing by a stationary guide member received within an axial bore in said axially movable member and is secured to said guide member by a heat meltable connection which when melted permits said axial movably member to move over said guide member, said guide member being affixed to and electrically connected to said second current-heatable means, and there is provided a transverse partition-forming second holding member similar to said spring holding member and slidable axially along the second current-heatable means and when passed beyond the inner end of said second current-heatable means is then relatively rotatable with respect thereto into a position where it becomes captured between a shoulder on said guide member and the end of said current-heatable means, and an arc-quenching material in the compartment on the outer side of said transverse partition-forming member.

28. The time delay fuse of claim 2 wherein there is provided on said movable member a third axially facing shoulder positioned to obstructingly limit the axial movement of said spring holding member so that when said spring holding member is urged against said third shoulder it is located at said given relative axial position, and wherein said third shoulder is configured to blockingly confront said aligned slots.

* * * * *